US009812781B2

(12) United States Patent
Blodt

(10) Patent No.: US 9,812,781 B2
(45) Date of Patent: Nov. 7, 2017

(54) ANTENNA APPARATUS FOR TRANSMITTING DATA OF A FILL-LEVEL MEASURING DEVICE

(71) Applicant: Endress + Hauser GmbH + Co. KG, Maulburg (DE)

(72) Inventor: Thomas Blodt, Basel (CH)

(73) Assignee: Endress + Hauser GmbH + Co. KG, Maulburg (DE)

( * ) Notice: Subject to any disclaimer, the term of this patent is extended or adjusted under 35 U.S.C. 154(b) by 0 days.

(21) Appl. No.: 14/648,962

(22) PCT Filed: Nov. 26, 2013

(86) PCT No.: PCT/EP2013/074689
§ 371 (c)(1),
(2) Date: Jun. 2, 2015

(87) PCT Pub. No.: WO2014/086616
PCT Pub. Date: Jun. 12, 2014

(65) Prior Publication Data

US 2015/0325916 A1 Nov. 12, 2015

(30) Foreign Application Priority Data

Dec. 3, 2012 (DE) ..... 10 2012 111 732

(51) Int. Cl.
*H01Q 7/08* (2006.01)
*H01Q 7/00* (2006.01)
(Continued)

(52) U.S. Cl.
CPC ..... *H01Q 7/00* (2013.01); *H01Q 1/225* (2013.01); *H01Q 7/06* (2013.01); *H01Q 7/08* (2013.01)

(58) Field of Classification Search
CPC ..... H01Q 7/00; H01Q 7/06
(Continued)

(56) References Cited

U.S. PATENT DOCUMENTS 4,114,161 A 9/1978 Shibano
7,342,475 B2 3/2008 Weger
(Continued)

FOREIGN PATENT DOCUMENTS

CH 335727 1/1959
CN 102269805 A 12/2011
(Continued)

OTHER PUBLICATIONS

English Translation of International Preliminary Report on Patentability, WIPO, Geneva, Jun. 18, 2015.
(Continued)

*Primary Examiner* — Peguy Jean Pierre
(74) *Attorney, Agent, or Firm* — Bacon & Thomas, PLLC

(57) ABSTRACT

Antenna apparatus for transmitting data of a fill-level measuring device, comprising at least two coil arrangements (i=1, 2 . . . n). The coil arrangements i=1, 2 . . . n have a coil length ($l_i$) and a coil diameter ($d_i$), wherein the coil diameter ($d_i$) is less than the associated coil length ($l_i$). The coil arrangements (i=1, 2 . . . n) each intersect a straight line (e) in such a way that the straight line (e) and the longitudinal axis of the coil arrangements (i=1, 2 . . . n) form at the intersection an acute or 90° angle of intersection (g) of at least 85°, wherein the intersection of each coil arrangement (i=1, 2 . . . n) is arranged at a position between $$\frac{3}{7}l_i \text{ and } \frac{4}{7}l_i,$$

(Continued)

wherein the at least two coil arrangements (i=1, 2 . . . n) are arranged along this line (e) in a sequence, in the case of which the coil lengths $l_i$ of the coil arrangements (i=1, 2 . . . n) monotonically decrease $l_1>l_2>\ldots l_n$. The at least two coil arrangements (i=1, 2 . . . n), in each case, have a separation ($s_i$) along the line (e) between the coil arrangement (i) and (i+1), which is, at most, a fourth as large as the coil length ($l_i$).

16 Claims, 5 Drawing Sheets

(51) Int. Cl.
*H01Q 7/06* (2006.01)
*H01Q 1/22* (2006.01)

(58) Field of Classification Search
USPC ..... 343/788, 700 MS
See application file for complete search history.

(56) References Cited

U.S. PATENT DOCUMENTS

| | | | | |
|---|---|---|---|---|
| 8,397,566 | B2 | 3/2013 | Michalski | |
| 8,933,709 | B2 | 1/2015 | Volker | |
| 8,970,442 | B2 | 3/2015 | Siekmanmn et al. | |
| 8,988,896 | B2 | 3/2015 | Wittmer et al. | |
| 2002/0105470 | A1* | 8/2002 | Kim | H01Q 1/2216 343/741 |
| 2008/0136739 | A1 | 6/2008 | Wong | |
| 2009/0051376 | A1 | 2/2009 | Schnell et al. | |
| 2009/0128436 | A1* | 5/2009 | Guo | H01Q 1/38 343/772 |
| 2009/0251376 | A1 | 10/2009 | Takahashi | |
| 2012/0262003 | A1 | 10/2012 | Tetu | |
| 2014/0197930 | A1 | 7/2014 | Zenuni et al. | |
| 2014/0214366 | A1 | 7/2014 | Girardey | |
| 2014/0308896 | A1 | 10/2014 | Baret et al. | |

FOREIGN PATENT DOCUMENTS

| | | | |
|---|---|---|---|
| DE | 1466271 | A1 | 1/1969 |
| DE | 19717505 | A1 | 11/1998 |
| DE | 102004025076 | A1 | 12/2005 |
| DE | 102005051493 | A1 | 7/2007 |
| DE | 102008043298 | A1 | 5/2010 |
| DE | 102009019724 | A1 | 11/2010 |
| DE | 102011104878 | A1 | 12/2012 |
| DE | 102011081268 | A1 | 2/2013 |
| DE | 102011081517 | A1 | 2/2013 |
| DE | 102011082002 | A1 | 3/2013 |
| DE | 102011087588 | A1 | 6/2013 |
| EP | 1774616 | B1 | 4/2007 |
| EP | 2293383 | A2 | 3/2011 |
| EP | 2515446 | A1 | 10/2012 |
| JP | H08102613 | | 4/1996 |
| WO | 2004066438 | A1 | 8/2004 |
| WO | 2007048399 | A1 | 5/2007 |

OTHER PUBLICATIONS

International Search Report EPO, The Netherlands, Jan. 20, 2014.
German Search Report, German PTO, Munich, Sep. 17, 2013.
"Magnetische Antennen," by Christian Kaferlein et al., www.ib-haertling.de/amateurfunk/Magnetische_Antennen.pdf, 22 pp. in German.

* cited by examiner

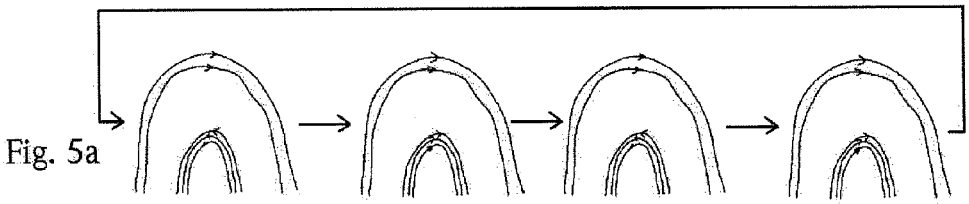
Fig. 5a
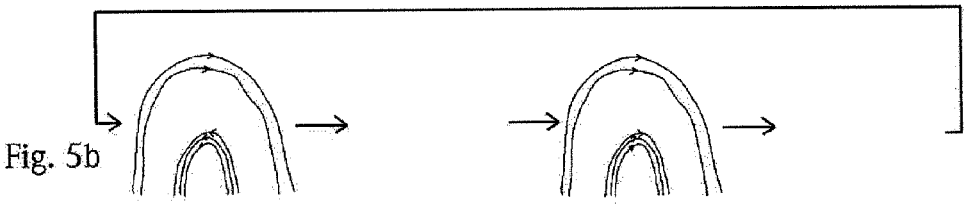
Fig. 5b
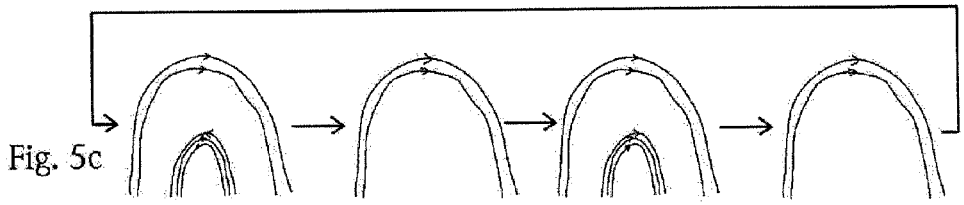
Fig. 5c
Fig. 6
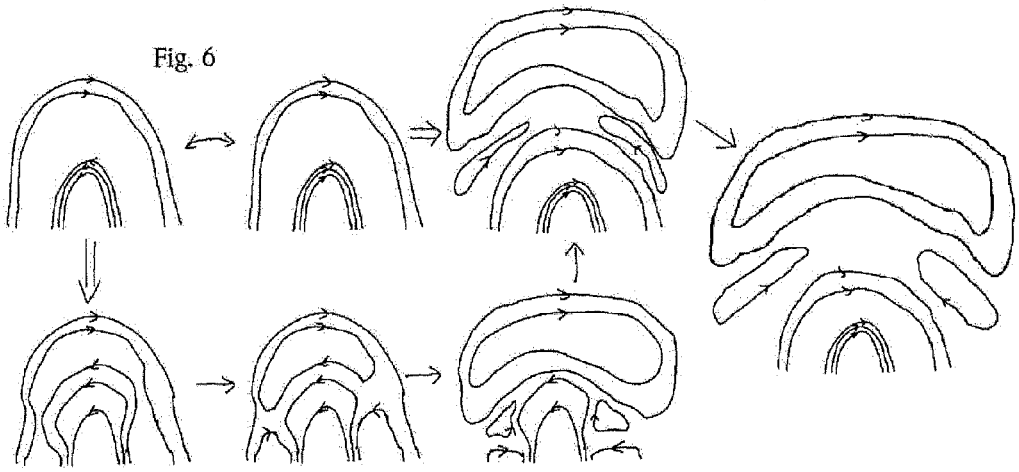

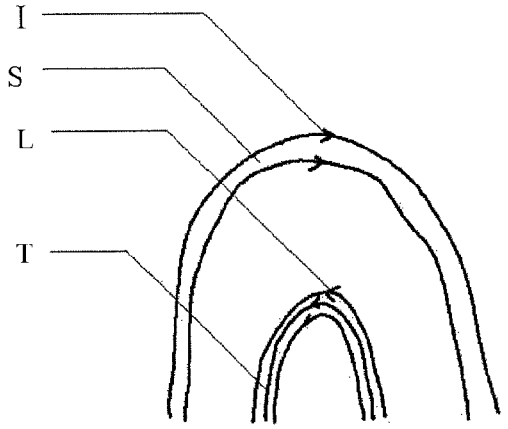
Fig. 7a
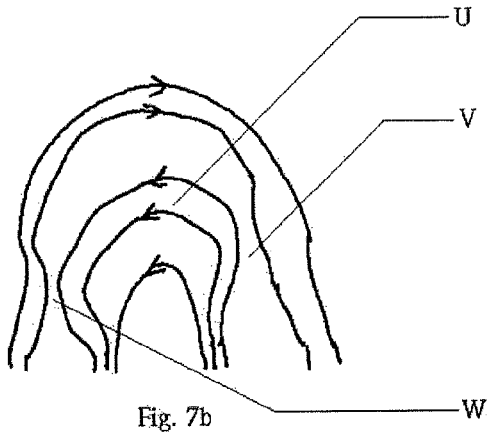
Fig. 7b
Fig. 8a
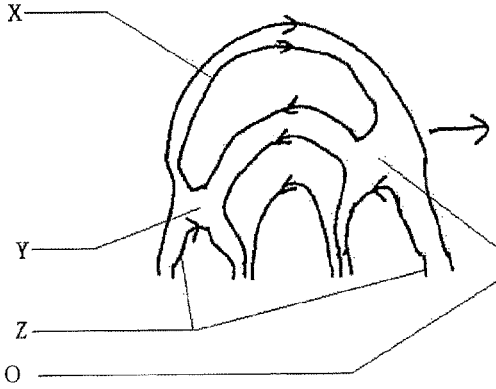
Fig. 8b
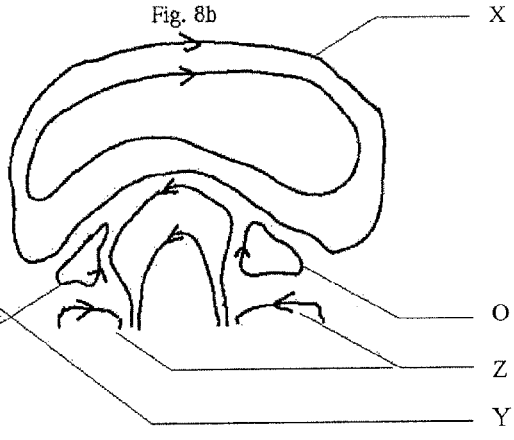

ANTENNA APPARATUS FOR TRANSMITTING DATA OF A FILL-LEVEL MEASURING DEVICE

TECHNICAL FIELD

The invention relates to an antenna apparatus for transmitting data of a fill-level measuring device.

BACKGROUND DISCUSSION

In automation technology, especially in process automation technology, field devices are often applied, which serve for determining, optimizing and/or influencing process variables. Serving for registering of process variables are sensors, such as, for example, fill level measuring devices, flow measuring devices, pressure- and temperature measuring devices, conductivity measuring devices, etc., which register the corresponding process variables, fill level, flow, pressure, temperature, and conductivity, respectively. Serving for influencing process variables are actuators, such as, for example, valves or pumps, via which the flow of a liquid in a pipeline section, respectively the fill level in a container, can be changed. Referred to as field devices are, in principle, all devices, which are applied near to the process and deliver, or process, process relevant information. In connection with the invention, the terminology, field devices, thus includes also remote I/Os and radio adapters, and, in general, all devices, which are arranged at the field level. A large number of such field devices are manufactured and sold by the firm Endress+Hauser.

Decisive for an antenna apparatus are its dimensions relative to the wavelength. Other properties of antenna apparatuses are the degree of bundling, as well as the range, which separates near field from far field. A higher degree of bundling is equivalent to a smaller "aperture angle" of the transmitted electromagnetic rays. The degree of bundling determines how strongly an antenna can focus. When the antenna apparatus represents, for example, a larger TV antenna, the antenna apparatus has a smaller receiving angle range and can more exactly be directed at the transmitter. The higher the degree of bundling, the more parallel radiated wave fronts leave from an antenna. Moreover, there are other properties, such as, for example, broadbandedness, matching (less reflection), aperture, pressure resistance and (energy-)efficiency, which must be optimized simultaneously relative to one another.

The near field is, relative to the wavelength, the region in the immediate vicinity of an antenna apparatus and the far field is, relative to the wavelength, located a significant distance from the antenna apparatus. Far field means virtually no phase difference between electrical and magnetic fields and their oscillation directions are perpendicular to one another. This is especially advantageous for data connections over greater distances measured relative to the wavelength in the case of high data rates, such as, for example, mobile telephony, WLAN, directional radio links, Bluetooth, UMTS and LTE, since the radiated energy is radiated uniformly in the respectively desired one or more directions. Wave resistance depends on the properties of the atmosphere, respectively the surrounding material. The wave impedance for electrically non-conductive materials is the square root of the ratio of the complex permeability to the complex permittivity.

In the near field, there results from an evaluation of a Poynting vector in a case of transmission, an energy transmission back into the antenna apparatus, whereupon such is then radiated out again. A complex wave impedance results. The fraction of the energy coming directly back into the antenna apparatus can be selected by suitable dimensioning. In this way, transformers as well as NFC/RFID systems can be implemented within the near field range. In the case of RFID systems, the transmitted energy is sufficient to supply a small electronics unit, which contains, for example, a transmitter as well as other elements.

SUMMARY OF THE INVENTION

An object of the invention is to provide an antenna apparatus, which produces signals with a higher resolution.

This object is achieved by an antenna apparatus for transmitting data of a fill-level measuring device, comprising at least two, preferably three, coil arrangements i=1, 2 . . . n, in the case of which the coil arrangements i=1, 2 . . . n have a coil length $l_i$ and a coil diameter $d_i$, wherein the coil diameter $d_i$ is less than the associated coil length $l_i$ and the coil arrangements i=1, 2 . . . n each intersect a straight line in such a way that the straight line and the longitudinal axis of the coil arrangements i=1, 2 . . . n form at the intersection an acute or 90° angle of intersection g of at least 60°, preferably at least 75°, and especially preferably at least 85°, and wherein the intersection of each coil arrangement i=1, 2 . . . n is arranged at a position between $$\frac{1}{3}l_i \text{ and } \frac{2}{3}l_i$$

preferably between $$\frac{2}{5}l_i \text{ and } \frac{3}{5}l_i$$

especially preferably between $$\frac{3}{7}l_i \text{ and } \frac{4}{7}l_i,$$

and wherein the at least two, preferably three, coil arrangements i=1, 2 . . . n are arranged along this line in a sequence, in the case of which the coil lengths $l_i$ of the coil arrangements i=1, 2 . . . n monotonically decrease $l_1>l_2> \ldots l_n$, and wherein the at least two, preferably three, coil arrangements i=1, 2 . . . n, in each case, have a separation $s_i$ along the line between the coil arrangements i and i+1, which is, at most, exactly as large, preferably, at most, half as large and especially preferably, at most, a fourth as large, as the coil length $l_i$.

In such case, the coil arrangement can have no, one or more coil cores. If the coil arrangements i=1, 2 . . . n are arranged in a sequence, in which the coil lengths monotonically $l_1>l_2> \ldots l_n$ lessen, then the superpositioning of the electromagnetic waves of each coil arrangement i=1, 2 . . . n is favored from the coil arrangement i=1 with the greatest coil length $l_1$ in the direction of the coil arrangement i=n with the smallest coil length $l_n$. The electromagnetic waves, which exit from, respectively enter, the individual end regions of the coil arrangements i=1, 2 . . . n, superimpose in this direction to form a total wave front.

An antenna apparatus of the invention is distinguished by a spatially very limited near field and in comparison to the wavelength a very small size, whereby such is well suited for applications especially in the field of digital communications, for example, for wireless HART, Bluetooth, WLAN, DMR446 or SRD (historically LPD), however, due to the small near field range rather unsuitable for NFC and RFID. Through a suitable and likewise described circuitry, the selectivity of the antenna apparatus can be set with reference to frequency, for example, with a quartz crystal, extremely exactly, this being especially advantageous in the case of very narrow band communication with little power, consequently, electrical current saving for the field over long distances. Likewise possible are short range connections.

In a further development, the coil arrangements i=1, 2 . . . n have a curvature in the direction of a point on the line, which considered from the coil arrangement n with the smallest coil length $l_n$ lies on a side opposite the remaining coil arrangements i=1, 2 . . . n−1. If the coil arrangements i=1, 2 . . . n are curved in the direction of a point on the line, then the superpositioning of the electromagnetic waves, which emanate from the end regions of the respective coil arrangements i=1, 2 . . . n, is still further favored. These electromagnetic waves superimpose then still effectively to a total wave front, which preferably propagates in the direction of the curvature.

In an additional embodiment, a periodic voltage $U_i$ is placed on the coil arrangements i=1, 2 . . . n and the voltage $U_i$ of each coil arrangement has a phase difference $\phi_i$ relative to the two neighboring coil arrangements i=1, 2 . . . n, wherein $\phi_{i-1} \neq \phi_i \neq \phi_{i+1}$. If the coil arrangements i=1, 2 . . . n have a phase difference $\phi_i$, then the magnetic field lines, which emanate from one of the coil arrangements i=1, 2 . . . n, enter into all other coil arrangements i=1, 2 . . . n. This yields a constructive superpositioning of the magnetic field lines of all coil arrangements i=1, 2 . . . n.

In a further development, the phase differences $\phi_i$ can be time varied. Especially, the phase differences $\phi_i$ can be a half period. If the phase difference $\phi_i$ amounts to a half period, then the magnetic field lines, which, for example, emanate from a magnetic north pole of the coil arrangement i+1, can enter partially into a magnetic south pole of the neighboring coil arrangement i and/or i+2, etc. thus, the magnetic field lines, which emanate from the coil arrangements i=1, 2 . . . n, superimpose among one another and produce so a number of small and/or large magnetic eddy fields, which can propagate with the assistance of the associated electrical fields. In this case, a number of small and/or large magnetic eddy fields bring about a greater selectivity, which is accordingly perceived by the receiver.

In an additional form of embodiment, the voltages $U_i$ of uneven numbered and/or even numbered coil arrangements i=1, 2 . . . n have the same phase $\phi_1=\phi_3=\phi_5=$ . . . and/or $\phi_2=\phi_4=\phi_6=$ . . . . If the phases of every other coil arrangement are equal, then there is only a superpositioning of the field lines of neighboring magnetic poles of the coil arrangements i=1, 2 . . . n. This allows the superimposed magnetic field to be controlled better.

In a further development, the voltages $U_i$ comprise a digital signal. In this way, within the time span, in which the digital signal is placed on one of the coil arrangements i=1, 2 . . . n, there is a constant phase relationship relative to the other coil arrangements.

In a further development, the voltages $U_i$ are sinusoidal. A sinusoidal voltage on the coil arrangements effects circular magnetic eddy fields, which also propagate in this form and arrive at the receiver.

In a further development, the voltages $U_i$ are sinusoidal and are triggered with a digital signal. In this way, the phase difference within a certain time, namely when the voltage is constant, has a fixed phase difference relative to the other voltages.

In an additional form of embodiment, the coil arrangements i=1, 2 . . . n can have one or more coil cores. A coil core increases the magnetic field in the interior of the coil.

In a further development, the coil cores of the coil arrangements i=1, 2 . . . n can be permanent magnets. If only a constant voltage is placed on a coil arrangement, it is economical and economically advantageous to replace such coil arrangement with a permanent magnet.

In a further development, the coil lengths $l_i$ from i to i+1 are reduced by a length $\Delta l_i$ between $$\frac{1}{10}l_i \text{ and } \frac{5}{10}l_i,$$

preferably between $$\frac{2}{10}l_i \text{ and } \frac{4}{10}l_i$$

and especially preferably between $$\frac{3}{10}l_i \text{ and } \frac{4}{10}l_i,$$

$l_{i+1}=l_i-\Delta l_i$.

An ideal (passive) antenna includes a gate with a guided waveguide/signal line and a second gate as opening. If a signal is placed, respectively received, on one of these gates, such is transmitted to the respective other gate. In the case of real antennas, additional losses occur in this transmission (dielectric losses, ohmic losses on metal elements, conversion to heat). Thus, each technically implemented antenna apparatus reflects a small power fraction (technical expression "finite antenna matching"). If the coil lengths of the coil arrangements are halved along their sequence, then the end regions of the coil arrangements are equidistant to one another. This is especially advantageous for a field release process. In this way, a uniform radiation is achieved and a very small power fraction is reflected back in the case of this release.

BRIEF DESCRIPTION OF THE DRAWINGS

The invention will now be explained based on the drawing, the figures of which show as follows:

FIG. 5*a* is a change of the magnetic field lines of an antenna apparatus having two coil arrangements in the case of a reverse poling of one coil arrangement;

FIG. 5*b* is a change of the magnetic field lines of an antenna apparatus having two coil arrangements in the case of a reverse poling of one coil arrangement and intermediate time intervals without magnetic field production;

FIG. 5*c* is a change of the magnetic field lines of an antenna apparatus having two coil arrangements in the case of a reverse poling of one coil arrangement;

FIG. 6 are magnetic field lines, which propagate with the assistance of corresponding electrical field lines;

FIG. 7*a* are magnetic field lines of two coil arrangements, which are not operated simultaneously;

FIG. 7*b* are magnetic field lines of two coil arrangements, which are operated simultaneously;

FIG. 8*a* are magnetic field lines of two coil arrangements, which superimpose on one another;

FIG. 8*b* are superimposed magnetic field lines of two coil arrangements, which produce new magnetic eddy fields;

DETAILED DISCUSSION IN CONJUNCTION WITH THE DRAWINGS

Figure 1:
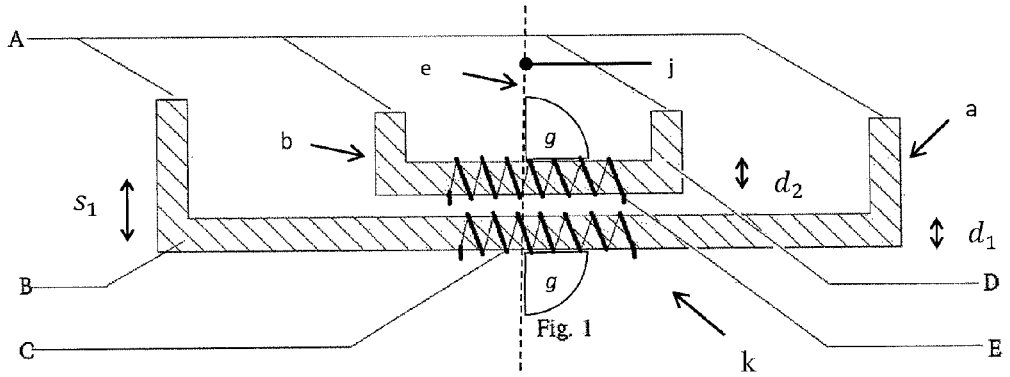
FIG. 1 is an antenna apparatus composed of two coil arrangements each having a coil and a coil core.

FIG. 1 shows an antenna apparatus k having a first coil arrangement a, a first coil C and a first U-shaped coil core B, wherein the first coil core B is a ferrite rod. A second coil arrangement b with a second U-shaped coil core D and a second coil E is located at a separation $s_1$ from the first coil arrangement a. The first and second coil arrangements a, b are arranged in the plane of the drawing and have a shared straight line e, wherein the straight line e is the transverse axis of the two coil arrangements a, b. Furthermore, the coil arrangements a, b have end regions A, which are arranged equidistantly from one another in a second plane, which is perpendicular to the plane of the drawing. The coil arrangements a, b can, however, also be arranged twisted or crossed relative to one another with the line e as rotation axis. Arranged on the line e is a point j, toward which first and second coil arrangements a, b curve. The first coil arrangement a has a first coil length $l_1$ and the second coil arrangement b a coil length $l_2$, wherein the coil lengths $l_1$, $l_2$ are measured between the end regions A of the respective coil arrangements a, b. The separation $s_1$ of the first coil arrangement a from the second coil arrangement b amounts in this embodiment to a fourth of $l_1$. Furthermore, the coil arrangements a, b assume, in each case, an angle of intersection g with the line e, which amounts to 90° in this embodiment. Furthermore, the coil arrangements a, b have respective first and second coil diameters $d_1$, $d_2$.

Figure 2A:
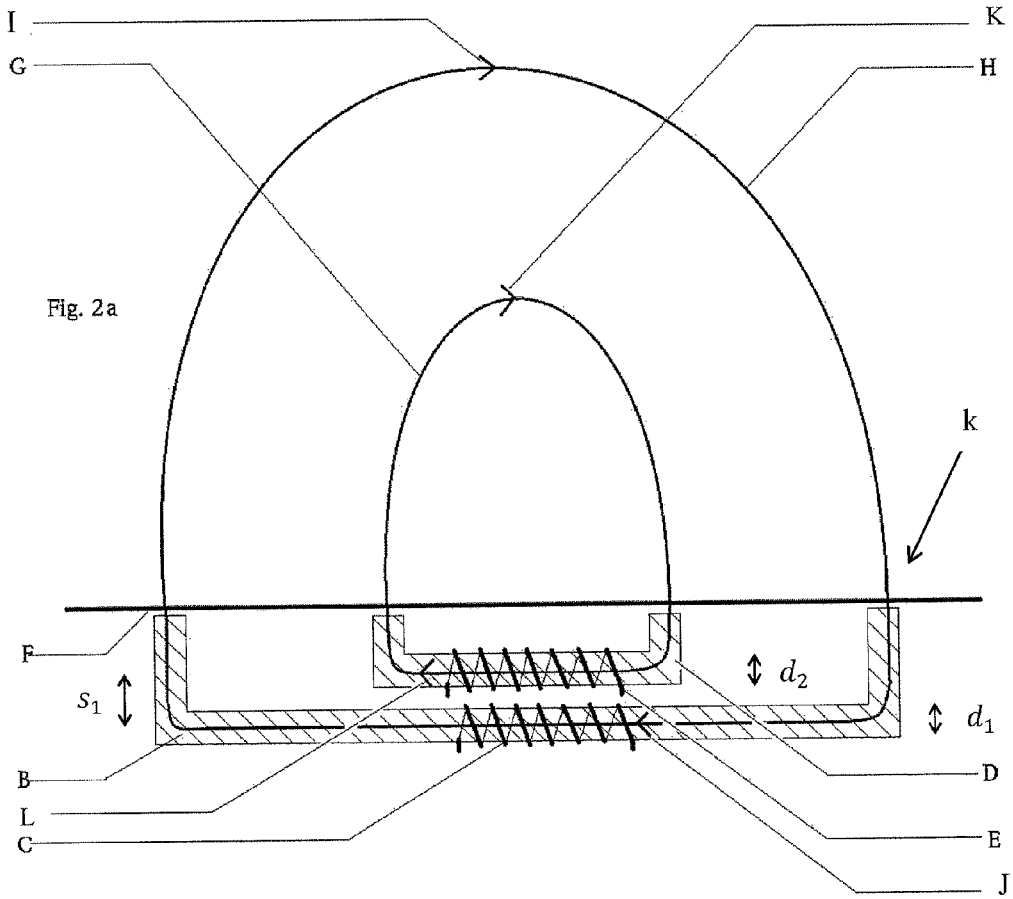
FIG. 2*a* is an antenna apparatus composed of two coil arrangements each having a coil and a coil core and associated same sense magnetic field lines.

If a first voltage $U_1$ is placed on the first coil core C, then a first magnetic field H is produced with a first outwards direction I and a first inwards direction J, wherein the magnetic field H enters, respectively emanates, through the end regions A of the first coil core B (see FIG. 2*a*). If a second voltage $U_2$ is placed on the second coil core E, then a second magnetic field G is produced with a second outwards direction K and a second inwards direction L.

If the first voltage $U_1$ and the second voltage $U_2$ are equally poled, then the outwards directions K, I and the inwards directions L, J have the same sense. The magnetic fields G, H interact essentially only outside the coil cores B, D above a plane F.

If oppositely poled voltages $U_1$, $U_2$ are placed on the coil cores B, D, the coil cores B, D produce magnetic fields G, H of opposite sense I, J, respectively K, L.

A continual alternation between same sense and opposite sense magnetic fields G, H, is achieved, for example, by reverse poling of one of the coils C, E and feeding of the respectively other coil C, E with direct voltage, in case the antenna apparatus k should receive electromagnetic waves. If the antenna apparatus k is to receive electromagnetic waves, the first coil C is connected directly with the receiver and the second coil E is continuously reverse poled with a half period of the frequency to be received. Suitable for this are, for example, so-called PIN-diodes, as well as SMD-HF transistors, which can operate at a frequency up to 26.5 GHz, and a few other HF transistors, which can operate at a frequency of more than 100 GHz.

If the switching of the coils C, E is controlled, for example, using a quartz crystal, a controlled circuit or another reference, a very good selectivity can be achieved as regards frequency or synchronization between receiver and transmitter. A variant thereof would be a so-called phase control loop, also referred to as a PLL circuit, especially embodiments involving reconstruction of the transmission phase position.

The coil arrangements a, b must be differently dimensioned, in order to achieve an as short as possible near-field region, as well as an as broad as possible antenna lobe in the antenna diagram, in order to have an as good as possible and clean releasing of the magnetic field from the antenna apparatus k.

Figure 4:
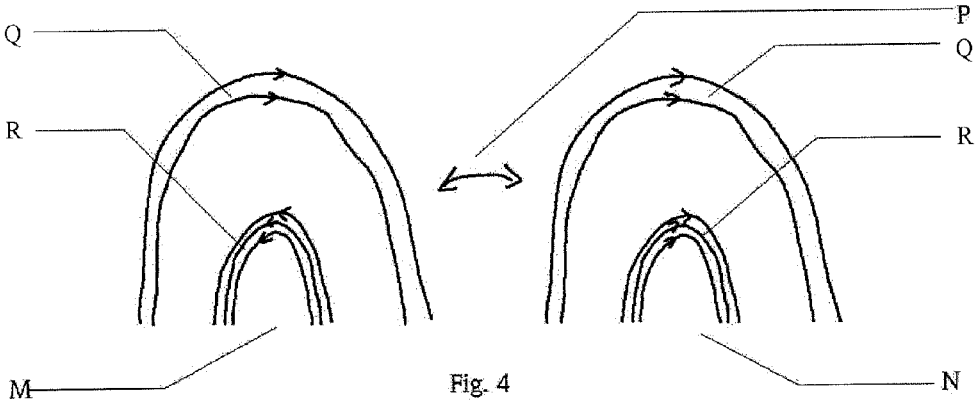
FIG. 4 is a change of the magnetic field lines of an antenna apparatus having two coil arrangements in the case of a reverse poling of one coil arrangement.

FIG. 4 shows a first field configuration M and a second field configuration N of magnetic fields. The first field configuration M shows the first magnetic field Q of a first coil arrangement a and the second magnetic field R of a second coil arrangement b. The coils C, E of the coil arrangements a, b are supplied in such a way with the first and second voltages $U_2$ that the first magnetic field Q and the second magnetic field R are of opposite sense. Within a certain time, a field change P from the field configuration M to the field configuration N can take place. The coils C, E of the coil arrangements a, b are in such case supplied with first and second voltages $U_2$ in such a way that the first magnetic field Q and the second magnetic field R have the same sense. It is insignificant which of the two magnetic fields Q, R is changed. Likewise, one or both of the coil arrangements a, b can be twisted relative to one another, wherein a rotation time can be varied. Essential is that the magnetic fields Q, R undergo a directional change relative to one another.

Three methods are provided for performing the field change P (see FIG. 5*a*). A switching occurs digitally or virtually digitally, i.e. without intermediately lying pause. In such case, the flow direction of the first coil arrangement a is held constant, and the flow direction of the second coil arrangement b is abruptly reverse poled. As concerns the circuit, this is relatively simple to implement and possible using cost effective digital technology, for example, with two CMOS-compatible output channels of a microprocessor. In this way, the HF-electronics can essentially be shifted into a microprocessor, whose frequency accuracy is assured, for example, using a quartz crystal circuit.

FIG. 5*b* shows supplementally to the procedure in FIG. 5*a* use of an electrical current, which flows through the first coil core B of the first coil arrangement a and is switched off after a reverse poling of the second coil core D of the second coil arrangement b. To this end, a sinusoidal or sine-like (for example, raised-cosine or two virtually sine, digital outputs of a digital circuit, PWM, analog filter, smoothing capacitor, etc.) electrical current is applied. In this way, a better behavior of the antenna apparatus k can be implemented than in FIG. 5*a*.

Another variant is shown in FIG. 5*c*, wherein direct voltage is applied for one of the coil arrangements a, b or a permanent magnet is used. In such case, the electrical current through the first coil core B is held constant and the electrical current through the second coil core D is alternately reverse poled and/or switched off.

Mixed forms are also possible, for example, a sinusoidal (FIG. 5*b*) or digital (FIG. 5*a*) driving of a coil arrangement a, b together with a direct voltage (FIG. 5*c*) or the digital driving (FIG. 5*a*) of one of the coil arrangements a, b and a sinusoidal driving (FIG. 5*b*) of one of the other coil arrangements a, b.

A distribution of the magnetic fields and their release from the antenna apparatus k are shown in FIG. 6 and are described in detail in the following with the aid of additional figures.

Figure 3:
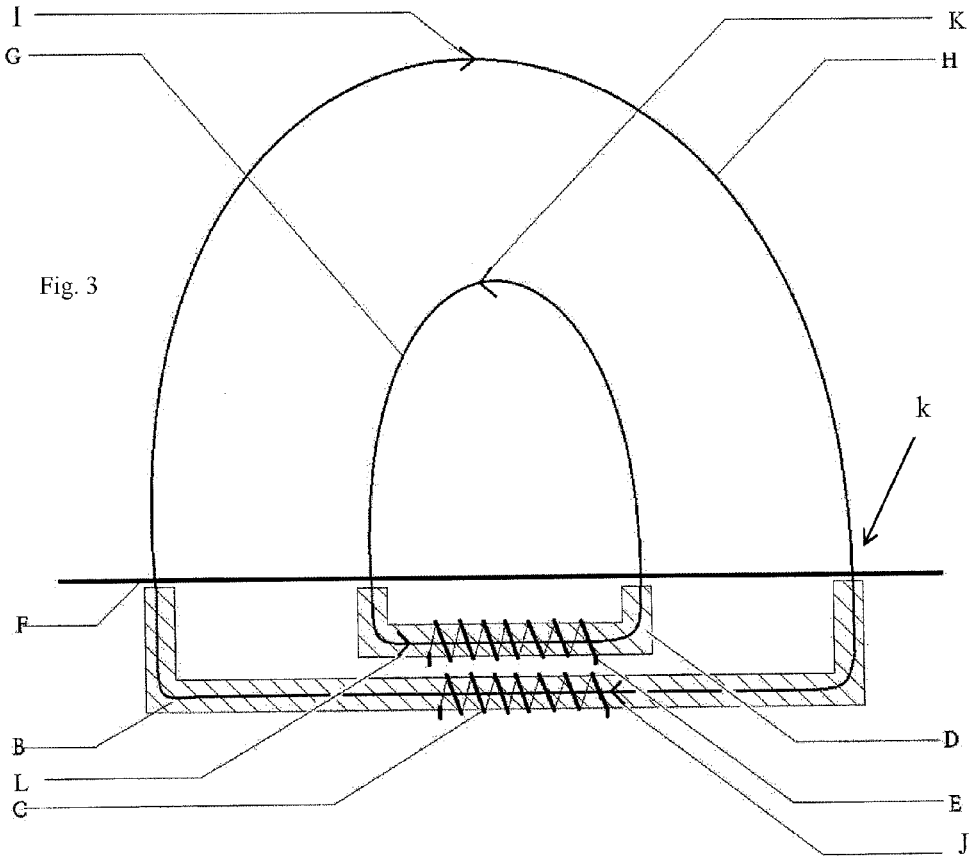
FIG. 3 is an antenna apparatus composed of two coil arrangements each having a coil and a coil core and associated opposite sense magnetic field lines.

First, the distribution of the magnetic fields of two coil arrangements a, b corresponding to FIG. 3 is considered. In FIG. 7*a*, analogously to FIG. 3, a third magnetic field S of the first coil arrangement a and a fourth magnetic field T of a second coil arrangement b are shown. The magnetic fields S, T have, respectively, a first outwards direction I, respectively a second outwards direction L. Each of the magnetic fields S, T is shown by a plurality of magnetic field lines. The number of magnetic field lines is proportional to the respective field density of the respective magnetic field S, T. As a result, the first magnetic field S has a smaller field density than the second magnetic field T. Furthermore, the outwards directions I, L are of opposite sense.

In FIG. 7*a*, the magnetic fields S, T are shown under the assumption that the coil cores C, E of the coil arrangements a, b are supplied sequentially with electrical current. In order to obtain an interaction of the magnetic fields S, T, the coil cores C, E must be supplied simultaneously with electrical current. If the fields interact with one another, there results a distribution of the magnetic fields according to FIG. 7*b* with a first region V and a second region W in which the magnetic fields S, T pull in. As a result of this drawing in, a third region U is produced, in which the (two-dimensionally considered enclosed) magnetic field T widens with lesser expansion in a direction opposed to the antenna apparatus k.

In an additional, release process of the magnetic field lines of the magnetic fields S, T of the antenna apparatus k, the magnetic field lines of the magnetic fields S, T close outside of the coil arrangements a, b (see FIG. 8*a*). These magnetic field lines, which close outside of the coil arrangements a, b, are referred to as majorities X and are separated from the fourth regions Y. Furthermore, there arise other magnetic field lines Z, which pass through the coil arrangements a, b and emanate from the main exit regions A of the first coil arrangement a and enter into the end regions A of the second coil arrangement b and vice versa. Thus, these magnetic field lines Z travel through both of the coil arrangements a, b. Since the fourth regions Y are relatively small, the majorities X are relatively near to the antenna apparatus k. As time goes on (FIG. 8*b*), the majorities X move farther away and there arise other closed magnetic field lines outside of the coil arrangements a, b with smaller diameters than the majorities X, so that they are referred to as minorities O.

Figure 9A:
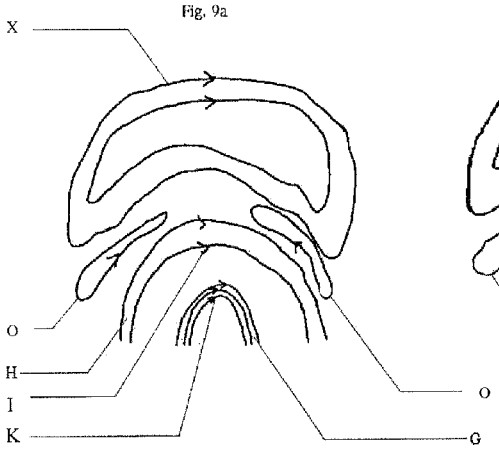
FIG. 9*a* are newly produced magnetic eddy fields and the next period for not yet superimposed magnetic field lines of two coil arrangements.
Figure 9B:
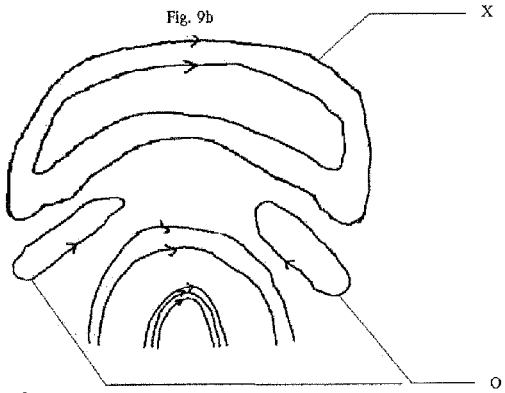
FIG. 9*b* are newly produced magnetic eddy fields and the next period for not yet superimposed magnetic field lines of two coil arrangements.

With more time (FIG. 9*a*), the magnetic fields G, H are then produced, as described, with the same sense in the direction I, K analogous to FIG. 2*a*. With this there occurs further release of multiple minorities O, from which the side lobes in an antenna diagram result, as well as further release of the majorities X, from which the main lobe of the antenna diagram results. The main lobe has a very broad angle. With additional time, the side lobe causing minorities O (FIG. 9*b*) are pushed further to the side. This leads to a broadening of the minorities O. A broad main lobe means a very uniform radiation of the electromagnetic wave, which is then approximately hemispherical.

Figure 10:
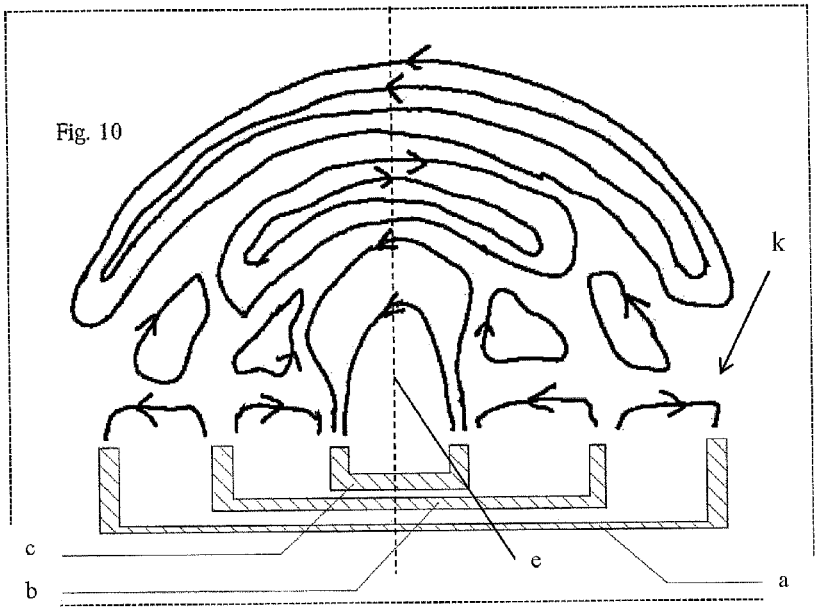
FIG. 10 are superimposed magnetic field lines of three coil arrangements.

FIG. 10 shows in contrast to the previous figures an antenna apparatus k with three coil arrangements a, b, c. These can be twisted relative to one another, wherein the straight line e serves as rotation axis.

The exact point in time of the change can favor a three-dimensional propagation; the same is true for a number of coil arrangements a, b, c arranged at a fixed angle relative to one another, for example, 90°, 60° or 45°, and these can be operated in parallel or easily offset in time. Through a suitable choice of parameters, for example, a circular polarization or an elliptical main lobe can be achieved.

The invention claimed is:

1. An antenna apparatus for transmitting data of a fill-level measuring device, comprising:

at least two coil arrangements, said coil arrangements have a coil length ($l_i$) and a coil diameter ($d_i$), wherein:

the coil diameter ($d_i$) is less than the associated coil length ($l_i$);

said coil arrangements each intersect a straight line (e) in such a way that the straight line (e) and the longitudinal axis of said coil arrangements form at their intersection an angle of 90°;

the intersection of each coil arrangement is arranged at a position between $$\frac{1}{3}l_i \text{ and } \frac{2}{3}l_i,$$

said at least two coil arrangements are arranged along this line (e) in a sequence, which the coil lengths $l_i$ of the coil arrangements monotonically decrease $l_1>l_2>\ldots l_n$; and said at least two coil arrangements, in each case, have a separation along the line (e) between the coil arrangement (i) and (i+1), which is, at most, exactly as large, as the coil length ($l_i$) of the longer coil, respectively.

2. The apparatus as claimed in claim 1, wherein:

said coil arrangements have a curvature in the direction of a point on the line (e), which considered from the coil arrangement with the smallest coil length ($l_n$) lies on a side opposite the remaining coil arrangements.

3. The apparatus as claimed in claim 1, wherein:

a periodic voltage is placed on said coil arrangements and the voltage of each coil arrangement has a phase difference relative to the two neighboring coil arrangements.

4. The apparatus as claimed in claim 3, wherein:

said phase differences can be time varied.

5. The apparatus as claimed in claim 3, wherein:

the voltages of uneven numbered and/or even numbered coil arrangements have the same phase $\phi_1=\phi_3=\phi_5=\ldots$ and/or $\phi_2=\phi_4=\phi_6=\ldots$.

6. The apparatus as claimed in claim 3, wherein:
said voltages comprise a digital signal.

7. The apparatus as claimed in claim 3, wherein:
said voltages are sinusoidal and/or cosinusoidal.

8. The apparatus as claimed in claim 3, wherein:
said voltages are sinusoidal and/or cosinusoidal and are triggered with a digital signal.

9. The apparatus as claimed in claim 8, wherein:
said coil cores of said coil arrangements can be permanent magnets.

10. The apparatus as claimed in claim 3, wherein:
said phase difference can be a half period.

11. The apparatus as claimed in claim 1, wherein:
said coil lengths ($l_i$) from (i) to (i+1) are reduced by a length ($\Delta l_i$) between $$\frac{2}{10}l_i \text{ and } \frac{4}{10}l_{i+1} = l_i - \Delta l_i.$$

12. The apparatus as claimed in claim 1, wherein:
said coil lengths ($l_i$) from (i) to (i+1) are reduced by a length ($\Delta l_i$) between between $$\frac{3}{10}l_i \text{ and } \frac{4}{10}l_i,\ l_{i+1} = l_i - \Delta l_i.$$

13. The apparatus as claimed in claim 1, wherein:
said coil arrangements can have one or more coil cores.

14. The apparatus as claimed in claim 1, wherein:
said coil lengths ($l_i$) from (i) to (i+1) are reduced by a length ($\Delta l_i$) between $$\frac{1}{10}l_i \text{ and } \frac{5}{10}l_i.$$

15. The apparatus as claimed in claim 1, wherein:
the intersection of each coil arrangement is arranged between $\frac{2}{5}\ l_i$ and $\frac{3}{5}\ l_i$.

16. The apparatus as claimed in claim 1, wherein:
the intersection of each coil arrangement is arranged between $\frac{3}{7}\ l_i$ and $\frac{4}{7}\ l_i$.

* * * * *